US010598373B2

(12) United States Patent
Xu et al.

(10) Patent No.: US 10,598,373 B2
(45) Date of Patent: Mar. 24, 2020

(54) METHOD AND DEVICE FOR GENERATING STEAM COMPRISING A SCALE CONTAINER AND STEAMER APPLIANCE WITH SUCH A DEVICE

(71) Applicant: KONINKLIJKE PHILIPS N.V., Eindhoven (NL)

(72) Inventors: Zhifeng Xu, Eindhoven (NL); Mohankumar Valiyambath Krishnan, Eindhoven (NL); Yen Leng Pang, Eindhoven (NL); Milind Vishwas Date, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 319 days.

(21) Appl. No.: 15/544,105

(22) PCT Filed: Jan. 12, 2016

(86) PCT No.: PCT/EP2016/050406
§ 371 (c)(1),
(2) Date: Jul. 17, 2017

(87) PCT Pub. No.: WO2016/116319
PCT Pub. Date: Jul. 28, 2016

(65) Prior Publication Data

US 2018/0003377 A1 Jan. 4, 2018

(30) Foreign Application Priority Data

Jan. 23, 2015 (EP) ..... 15152224

(51) Int. Cl.
*F22B 1/28* (2006.01)
*D06F 75/18* (2006.01)
*F22B 27/16* (2006.01)

(52) U.S. Cl.
CPC ..... *F22B 1/287* (2013.01); *D06F 75/18* (2013.01); *F22B 1/288* (2013.01); *F22B 27/165* (2013.01)

(58) Field of Classification Search
CPC ..... F22B 1/287; F22B 27/165; F22B 1/288; D06F 75/18
(Continued)

(56) References Cited

U.S. PATENT DOCUMENTS 2,750,690 A 6/1956 Gomersall
3,115,718 A 12/1963 Henzirohs
(Continued)

FOREIGN PATENT DOCUMENTS

DE 19847670 A1 4/1999
JP 56145900 11/1981
(Continued)

*Primary Examiner* — Thien S Tran

(57) ABSTRACT

The present invention relates to a device (1) for generating steam. The device (1) comprises a plate (2) forming a surface, and a heating element (3) to heat the plate (2) to a predetermined temperature being at least above water evaporation temperature. The plate (2) is inclined at an angle compared to the horizontal direction to define an upper end and a lower end. The device (1) also comprises a water inlet arrangement (4) for dispensing water onto the plate (2) proximate the upper end, a control unit (11) to control the flow of water dispensed onto the plate (2), and a scale collection container (5) disposed adjacent to the plate (2). The control unit (11) is configured to control the flow of water dispensed onto the plate (2) and the temperature of the plate (2) so that substantially all the water dispensed onto the plate (2) evaporates before it reaches the lower end (15) of the plate (2). This invention allows an easy scale collection, thanks to the inclination angle of the plate's surface that causes the dislodged scale to travel down the plate's surface
(Continued)

toward the lower end of the plate and, ultimately, into the container.

20 Claims, 5 Drawing Sheets

(58) Field of Classification Search
USPC ..... 219/401, 442
See application file for complete search history.

(56) References Cited

U.S. PATENT DOCUMENTS 4,091,551 A * 5/1978 Schaeffer ..... D06F 75/18 38/77.83
4,240,217 A * 12/1980 Schwob ..... D06F 75/18 38/77.83
4,414,766 A 11/1983 Schwob
4,724,824 A 2/1988 McCoy
5,388,602 A 2/1995 Coassin
5,613,309 A 3/1997 Amsel
5,713,309 A 2/1998 Higashi
6,604,493 B1 8/2003 Toki
8,177,936 B2 5/2012 Berghaenel
2016/0370000 A1 * 12/2016 Chua ..... D06F 75/18

FOREIGN PATENT DOCUMENTS

JP 58075600 5/1983
JP 2000345932 A 12/2000
RU 2433337 11/2011
WO 2015/010970 1/2015
WO 2015010968 A1 1/2015

* cited by examiner

METHOD AND DEVICE FOR GENERATING STEAM COMPRISING A SCALE CONTAINER AND STEAMER APPLIANCE WITH SUCH A DEVICE

This application is the U.S. National Phase application under 35 U.S.C. § 371 of International Application No. PCT/EP2016/050406, filed on Jan. 12, 2016, which claims the benefit of International Application No. 15152224.0 filed on Jan. 23, 2015. These applications are hereby incorporated by reference herein.

FIELD OF THE INVENTION

The present invention relates to a steam generation device, in particular to a steam generation device that allows collecting scale.

BACKGROUND OF THE INVENTION

Water heating devices designed to substantially raise the temperature of a body of water, and in some cases generate steam, are known to be prone to deposits of scale forming on the heat source. Commonly affected devices include steam generation devices such as a boiler, as well as conventional water heating devices such as a kettle.

Scale is formed when dissolved solids in the water, such as sulphates or carbonates of calcium and magnesium, are deposited as the water is turned to steam. The layers of scale create an insulating layer around the heat source and reduce the energy efficiency and speed of the water heating process. Furthermore, the insulating layer of scale can cause the heat source to accumulate excess heat so that the temperature of the working components exceeds that required for safe and reliable operation.

Another problem associated with scale is that small fragments of the scale will become detached during steam generation and entrained in the steam flow. In the example of a steam iron, these small fragments of scale are deposited on the garment causing the garment to become dirty.

Scale is typically removed from the heat source by cleaning with a weak acid or by physically scraping off the scale. Both options involve effort and expense and require the steam generation process to be postponed.

Alternatively, it is possible to prevent scale formation by chemically treating water to remove dissolved solids. Ion exchange methods are commonly employed to reduce total dissolved solids, wherein a resin impregnated with sodium ions is arranged to exchange the sodium ions with ions from the dissolved solids in the surrounding water. Disadvantageously, this method requires an additional process and supporting equipment to carry out, which can increase the cost and complexity of steam generation.

Traditional steam generation devices require that the heating element is entirely submerged by the water source such that, in equilibrium of the system, the heating element and scale layer are maintained at a constant temperature. More recent technologies have emerged that generate steam by dripping water onto a heated surface, causing a sudden temperature fluctuation of the plate and scale layer. The temperature fluctuation causes mechanical stress in the scale, which if greater than the scale's tensile strength, causes the scale to break up. The scale is then more easily removed by rinsing or physically scraping the heated surface.

Water dripped onto a heated surface forms a film and migrates across the surface due to the plate surface conditions and the surface tension of the water. This leads to an uneven and unpredictable distribution of water and therefore an uneven and unpredictable distribution of scale. In areas where water pools or gathers, thicker deposits of scale are formed that are harder to break up.

A soleplate for a steam iron is disclosed in U.S. Pat. No. 4,091,551. The soleplate disclosed in the document comprises a plate inclined at an angle to the horizontal having an upper and lower end. The soleplate further comprises a heating element to heat the soleplate, including the plate, and a water inlet arrangement for dispensing water onto the plate. The soleplate is heated to a temperature which evaporates the water.

OBJECT AND SUMMARY OF THE INVENTION

It is an object of the invention to propose a device for generating steam that avoids or mitigates above-mentioned problems.

The invention is defined by the independent claims. The dependent claims define advantageous embodiments.

According to the present invention, there is provided a device for generating steam.

The present invention relates to a device for generating steam. The device comprises a plate forming a surface, and a heating element to heat the plate to a predetermined temperature being at least above water evaporation temperature. The plate is inclined at an angle compared to the horizontal direction to define an upper end and a lower end. The device also comprises a water inlet arrangement for dispensing water onto the plate proximate the upper end, and a control unit to control the flow of water dispensed onto the plate. A scale collection container is disposed adjacent to the plate and comprises a bottom surface portion. The control unit is configured to control the predetermined temperature of the plate so that substantially all the water dispensed onto the plate evaporates before it reaches the lower end of the plate.

Dispensing water onto an angled heated plate causes it to form a thin film and evaporate more quickly than if the plate were flat. As the film of water being fed onto the plate is cold relative to the heated surface, any scale on the plate will be subjected to thermal shock. That is, the cooling effect of the water (at least until it evaporates) and the heating effect of the surface will induce thermal stresses and strains in any scale that has formed on the surface and cause it to break apart and dislodge from the surface. The inclination angle of the plate's surface causes the dislodged scale to travel down the plate's surface toward the lower end of the plate and, ultimately, into the container. Furthermore, the angle of inclination of the plate helps improve the efficiency of evaporation by overcoming the Leidenfrost effect. The Leidenfrost effect occurs when a droplet of water becomes suspended above a heated surface by a layer of vapour that has formed between the water and the heated surface. The vapour layer insulates the water suspended above and impedes heat transfer. In the present invention, the steep angle of the plate's surface ensures that water is continuously moved over said plate's surface by the action of gravity. The friction between the vapour layer and the surface of the plate causes a portion of the vapour to escape so that the water is in contact with the plate's surface and more quickly evaporated.

Preferably, the plate has at least one channel extending between the upper and the lower ends.

Preferably, the at least one channel comprises a plurality of channels extending parallel.

When water is dispensed onto a heated flat plate it forms a film, the direction of travel of the film relative to the plate is determined by a combination of the surface tension of the water and gravity. The effect of surface tension can cause the water to migrate transversely across the plate's surface so that separate rivulets gather and form a thicker film. The presence of channels prevents the water from migrating transversely across the plate's surface as the surface tension effect is insufficient to cause the water to escape the channel; the water is instead caused by gravity to travel down the channel and form a thinner film which will evaporate more quickly and use less energy than if a thicker film is allowed to form. Furthermore, the increased rate of evaporation means that the distance between the upper end and the lower end of the heated plate can be reduced for any given quantity of water dispensed.

Preferably, the bottom surface portion extends downwards in a plane parallel to the plane of the plate.

Preferably, the water inlet arrangement comprises a multiple water inlets for dispensing water onto multiple regions of the plate proximate said upper end.

If water is fed to multiple regions of the plate's surface, the water being fed onto the surface will cool the surface in those regions and will also cool any scale which has formed on the surface in those regions. Therefore, the scale will be cooled at different rates which will assist in inducing thermal shock which will act to break apart the scale.

Preferably, the number of water inlets is the same as the number of said plurality of channels, and wherein each water inlet faces one channel of said plurality of channels, respectively.

Preferably, the bottom surface portion comprises a horizontal surface portion being lower than said lower end.

Preferably, there is provided a plurality of plates which surround the container.

Preferably, the container is formed integrally with the plate.

Preferably, the plate is inclined at least 45 degrees from the horizontal.

Preferably, the container comprises a plurality of walls with a detachable opening formed in at least one of the walls to access an inside part of the container.

Preferably, according to the present invention there is provided a steamer appliance comprising a device for generating steam as described above.

Preferably, according to the present invention, there is provided a steamer appliance as described above comprising a water pump to deliver water to said water inlet arrangement, and a control unit for controlling the water flow rate delivered to the water inlet arrangement in dependence on said predetermined temperature.

According to another aspect of the invention there is provided, a method of collecting scale in a device for generating steam, said method comprising the steps of: heating a plate inclined at an angle compared to the horizontal direction, the plate being heated to a predetermined temperature being at least above water evaporation temperature, the plate defining an upper end and a lower end; dispensing water on said plate proximate said upper end; and collecting in a container the scale falling down from the plate, the container being disposed adjacent to said plate and comprising a bottom surface portion extending at least below said lower end.

BRIEF DESCRIPTION OF THE DRAWINGS

Embodiments of the invention will now be described, by way of example only, with reference to the accompanying drawings in which.

DETAILED DESCRIPTION OF THE EMBODIMENTS

Figure 1:
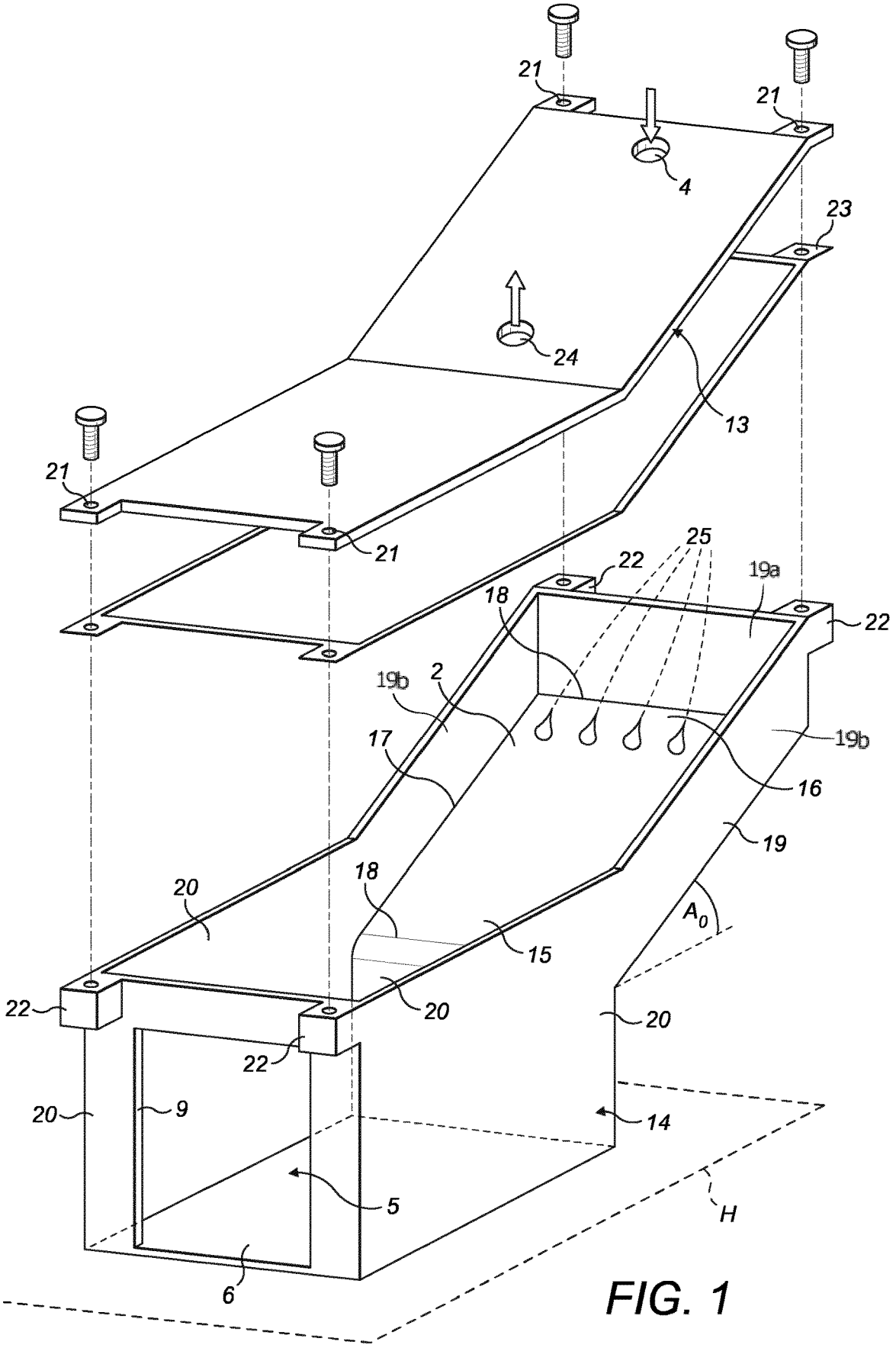
FIG. 1 is an exploded isometric view of a first embodiment of the present invention.

In all embodiments of the present invention, shown in FIGS. 1 to 6, there is provided a device 1 for generating steam. The device 1 comprises:

- a plate 2 forming a planar surface,
- a heating element 3 to heat the plate 2 to a predetermined temperature being at least above water evaporation temperature,
- the plate 2 being inclined at an angle A0 compared to the horizontal direction H to define an upper end 16 and a lower end 15,
- a water inlet arrangement 4 for dispensing water onto the plate 2 proximate said upper end 16,
- a container 5 disposed adjacent to said plate 2, said container 5 comprising a bottom surface portion 6 extending at least below said lower end 15.

The heated surface of plate 2 is inclined at a suitably steep angle A0 from the horizontal H. Water is deposited onto the heated surface at the top of the incline and allowed to migrate down the surface. The water's path of migration down the surface is governed by a combination of gravity and surface tension effects. The strong influence of gravity due to the steep angle of inclination of the surface increases the predictability and evenness of the water distribution across the surface, and therefore, increases the uniformity of scale thickness across the surface. As water is prevented from pooling on the surface by gravity, a thin and even layer of scale is formed that is more easily broken by the sudden cooling effect of successive drops of water.

A first embodiment of the invention is shown in FIG. 1 and comprises a steam generation device (1) comprising a casing (14) and a lid (13). The casing comprises a plate (2), preferably inclined at least 45 degrees from the horizontal (H) when the steam generation device (1) is in an operative position, and a scale collection container (5). Preferably, the plate (2) and scale collection container (5) are integrally formed as a single part. The scale collection container (5) is disposed adjacent to the plate (2) at the bottom of the plate's (2) incline.

The plate (2) provides the above mentioned heated surface onto which water is deposited when the device (1) is in operation. Scale formed on the plate is broken up by the process of flaking, so that flakes of scale are caused to migrate down the plate's (2) incline to pass off the lower end (15) of the plate.

The plate (2) comprises a four sided flat surface. In the following, the region of the plate (2) that is disposed at the top of the incline is referred to as the upper end (16), while the region of the plate (2) that is disposed at the bottom of the incline is referred to as the lower end (15). The plate (2) is rectangular in shape having two long sides (17) and two short sides (18). The plate is partially bordered by a wall (19) that extends around the sides of the plate to extend from the short side (18), adjacent the plate's upper end (16), and along both long sides (17), so that the plate is open at the lower end (15) to communicate with the scale collection container (5). The walls (19) include a wall portion (19*a*) extending along the short side (18) and walls portions (19*b*) extending along the long sides (17).

The scale collection container (5) comprises a flat rectangular base that defines a bottom surface wall (6) (hereafter bottom surface 6), and four lateral walls (20) extending from the outer edges of the bottom surface (6) to surround the bottom surface and to provide a receptacle into which scale is deposited. The bottom surface (6) is disposed below the lower end (15) of the plate (2) and is disposed in the horizontal (H) when the steam generation device (1) is in an operative position. The lower end (15) of the plate (2) is adjoined to the upper edge of a lateral wall (20) so that scale flaked off of the plate (2) may pass over the lateral wall (20) and into the receptacle. Two further lateral walls (20) extend to meet the walls (19) extending along long sides (17) of the plate (2). Preferably, the scale collection container (5) further comprises an opening (9) formed in a surface of the scale collection container (5) for providing access to the inside of the scale collection container (5) so that scale deposited therein can be easily removed. It shall be appreciated that this opening (9) may be formed in any surface or wall defining the scale collection container (5), including the bottom surface wall (6) and any of the four lateral walls (20). In the embodiment shown, the opening (9) is formed in the lateral wall (20) disposed opposite to the lateral wall (20) adjoining the plate (2). For example, the opening (9) is closed off by a detachable cover (12) shown in FIG. 2. The cover (12) is configured to seal the opening (9) so that steam and scale are contained within the steam generation device (1) when it is in use.

Figure 2:
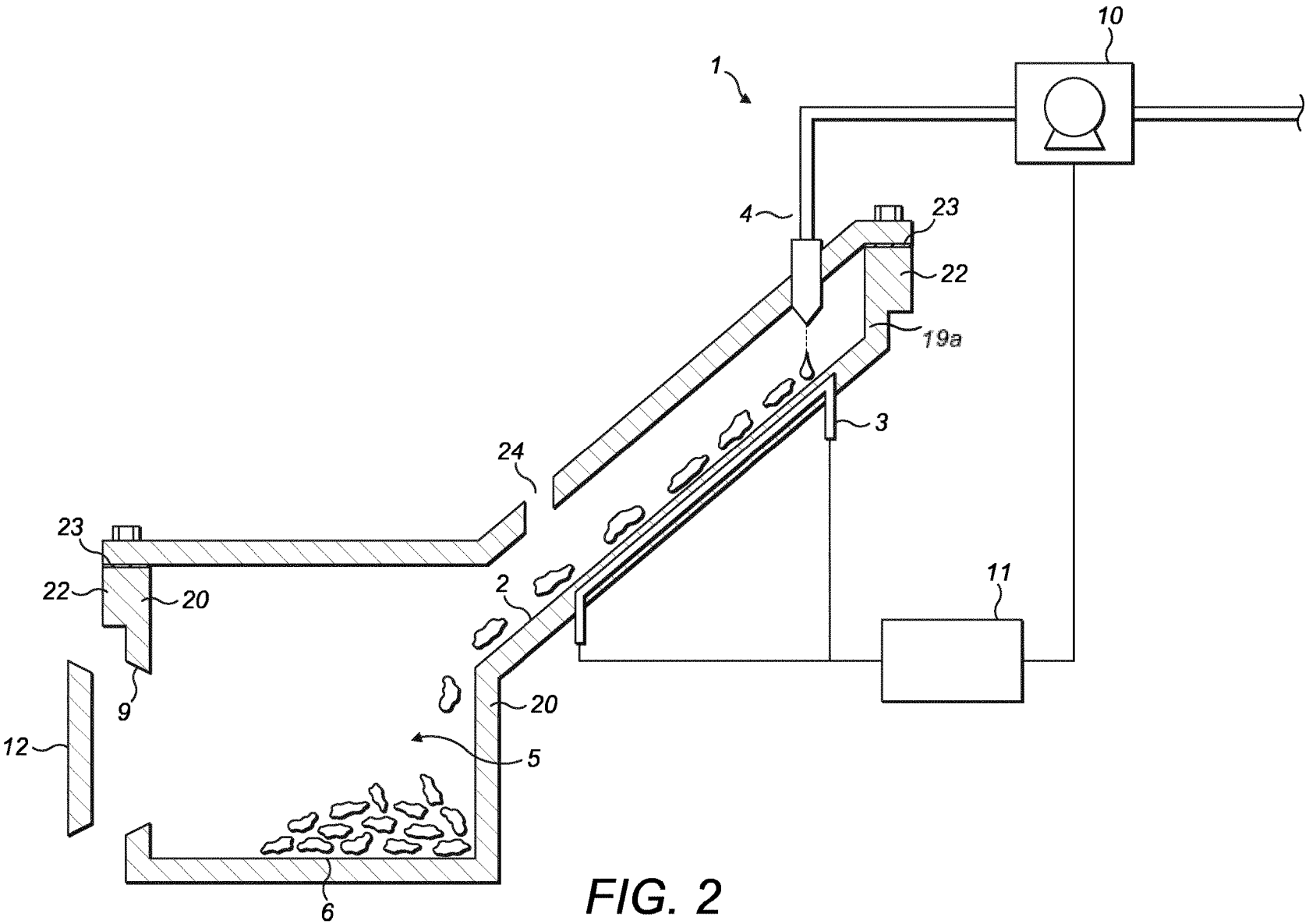
FIG. 2 is a cross sectional view of the embodiment shown in FIG. 1.

FIG. 2 shows the embodiment of FIG. 1 in cross section. In this view of the embodiment, the lid (13) is fixed onto the casing (14) to enclose the steam generation device (1). The lid (13) is held in place for example by screws passed through openings (21) provided in the lid (13) proximate the outer edges of the lid (13) and into correspondingly positioned threaded lugs (22). A gasket (23) is provided; the gasket (23) comprises a thin sheet of silicon sealing material cut to a shape corresponding to the upper edge of the casing (14) and disposed between, and abutting, the lid (13) and the casing (14) when the lid (13) is fixed onto the casing (13). Advantageously, the gasket (23) ensures that steam generated within the steam generation device (1) is contained therein.

The lid (13) comprises a steam outlet (24); the steam outlet (24) may be connected to any device, hose, pipe, tube, or other means for applying, using or conveying steam. For example, the steam outlet (24) may convey steam from within the steam generation device (1) to a steam passage of a soleplate of a steam iron, such as a steam iron typically used for the treatment of garments. Alternatively, the steam outlet (24) may convey steam from the steam generation device (1) into a hose connected to a steam applicator, such as a steam dispensing head, for applying steam to garments or other articles. It will be appreciated that the steam outlet (24) may alternatively be provided in the casing (14). Also, the device (1) may optionally comprise multiple steam outlets (24) to provide steam to multiple devices or applicators.

The lid (13) further comprises a water inlet (4), the water inlet (4) is arranged so as to dispense water onto the upper end (16) of the plate (2). In operation, water is applied through the water inlet (4) in droplet form. The water droplet is spread out into a thin film by the surface tension of the water and the action of gravity. It shall be appreciated that this film of water is thinner and more evenly distributed than if the plate (2) were substantially less inclined. This thin film of water is vaporised to produce steam causing scale to form on the plate's (2) surface. The amount of scale formed in each instance of evaporation is limited by the thickness of the water film layer.

The water inlet (4) is configured to dispense water onto multiple spaced regions (25) across the width of the upper end (16) of the plate (2) so that the water runs down the full width of the plate to utilise the whole of the plate's (2) surface. In an example of this embodiment, the water inlet (4) comprises a plurality of orifices (not shown) to simultaneously introduce multiple water droplets onto the plate (2).

A heating element (3) disposed proximate to the plate (2) acts to heat the plate (2). In this embodiment the heating element (3) is an electronic filament heater, though it shall be appreciated that any other suitable heater may be used. For the most efficient heat transfer between the heating element (3) and the plate (2), the heating element (3) is preferably embedded in the plate (2) (as shown in FIG. 2) so that the plate (2) envelopes all surfaces of the heating element (3) that act to transfer heat.

Preferably, in all embodiments, a temperature sensing device is also provided to measure the temperature of the plate (2) and in particular the temperature of the plate's (2) surface. As per the embodiment shown in FIG. 2, a temperature sensor (not shown) is disposed next to plate 2 and connected to a control unit (11) to derive the corresponding temperature of the plate 2. The control unit (11) can be further configured to control the temperature of the plate 2, for example by adjusting (i.e. increasing or decreasing) the power delivered to the heating element, to ensure that the temperature of plate 2 is at least above water evaporation temperature. The control unit (11) can be further configured to control the flow rate of water through the water inlet (4) in dependence on the temperature of the plate (2) sensed by the temperature sensor. The control unit (11) may operate a pump (10) and/or a valve (not shown) so as to control the flow rate of water supplied through the inlet to the plate (2) in dependence upon the temperature of the plate (2), as sensed by the temperature sensor, for the purpose of maximising the thermal shock effect. The flow of water may also be controlled to ensure that all the water that contacts the plate's (2) surface is evaporated and none of it, or substantially none of it, flows from the plate (2) into the scale collection container (5).

The heating element (3) may be an on-off type heating element (3), in which case the heating element (3) is turned on when the temperature of the plate's (2) surface falls below a predetermined value and is turned off when the temperature rises above a predetermined value. Alternatively, the heating element (3) may have a variable power output such that a more constant temperature can be maintained on the plate's (2) surface. In this way, the temperature of the plate's (2) surface can be accurately maintained at a sufficiently high temperature to evaporate the water being fed onto the plate's (2) surface before it reaches the scale collection container (5). Therefore, none of the water, or at least very little water, will accumulate in the scale collection container (5).

The heating element (3) is embedded within the plate (2) such that it is in close proximity to the plate's (2) surface.

This means that the heating element (3) is able to quickly heat the plate's (2) surface when the temperature drops, which will occur when water is fed onto the plate (2) and evaporated. The proximity of the heating element (3) to the plate's (2) surface reduces the lag time between switching on the heating element (3) and the subsequent increase in the temperature of the plate's (2) surface. Therefore, the device (1) is able to better regulate the temperature of the plate's (2) surface and maintain a high temperature, allowing the plate (2) to evaporate all water which is fed onto the plate's (2) surface and prevent water from reaching the scale collection container (5). The difference between the temperature of the plate (2) before and after water is fed onto the plate's (2) surface (or between wet and dry conditions during operation) may be at least 30 degrees Celcius. Preferably, the temperature difference may be at least 60 degrees Celcius. Furthermore, the temperature difference of the lateral walls (19) when the lateral walls (19) get wet and when the lateral walls (19) are dry may be at least 30 degrees Celcius. In other words, the temperature of the plate (2) (or the lateral walls (19)) when the plate (2) (or the walls (19)) is wet is at least 30 degrees Celsius lower compared to when the plate (2) (or the walls (19)) is dry during heating. The temperature difference creates a thermal shock in scale present on the plate which causes it to flake and migrate to the scale collection container (5).

Preferably, the water is evaporated in the area closest to the heating element (3). The heating element (3) may be positioned so that the main heating zone is in the middle of the plate (2) and distal to the walls (19). Therefore, water spreading over the plate (2) during steaming does not reach the surrounding walls (19). Effectively, the width of the wet (steaming) area is preferably less than the distance between the lateral walls portions (19*b*) along the long sides (17*b*). The water dosing position is also arranged in such a manner that the spreading water does not reach the wall portion (19*a*) along the short side (18). This may help to reduce or prevent scale carried by water being deposited along the walls (19). The surrounding walls (19) may be integral with the plate (2) or the enclosing lid (13).

Figure 3:
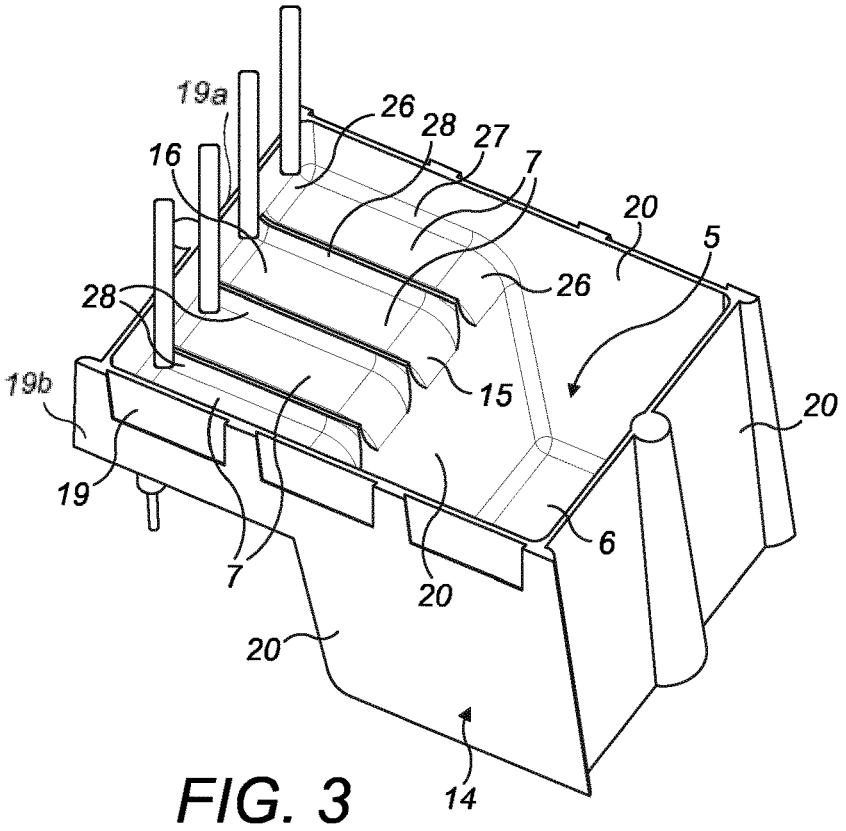
FIG. 3 is an isometric view of a second embodiment of the present invention.

The casing (14) of a second embodiment of the invention is shown in FIG. 3. As in above embodiments, a flat heated plate (2) is provided The plate (2) comprises a four sided rectangular surface with two long sides (26) and two short sides (27). The plate (2) has an upper end (16) and lower end (15) adjacent long sides (26) of the plate (2) respectively. The plate is partially bordered by a wall (19) that extends around three sides of the plate to extend from the long side (26), adjacent the plate's upper end (16), and along both short sides (27), so that the plate is open at the lower end (15) to communicate with the scale collection container (5). The plate (2) further comprises a number of walls (28) upstanding perpendicularly from the plate's (32) surface and extending longitudinally from the upper end (16) to the lower end (15) of the plate so as to divide the plate into a series of parallel channels (7). Multiple water inlets (not shown) are provided in the lid (not shown). The number of water inlets is equal to the number of channels (7) provided in the plate's (2) surface, with each water inlet arranged so as to face a respective channel (7).

In this second embodiment of the invention, the scale collection container (5) comprises a bottom surface (6) that is disposed below the plate (32) and extends in a plane parallel to the plate (32). As in the first embodiment, the scale collection container (5) further comprises four lateral walls (20) extending from the outer edges of the bottom surface (6) to surround the bottom surface (6) and to provide a receptacle into which scale is deposited. The lower end (15) of the plate (2) is adjoined to the upper edge of a lateral wall (20) so that scale flaked off of the plate (2) may pass over the lateral wall (20) and into the receptacle. Two further lateral walls (20) extend to meet the walls (19) extending along short sides (27) of the plate (2).

Figure 4:
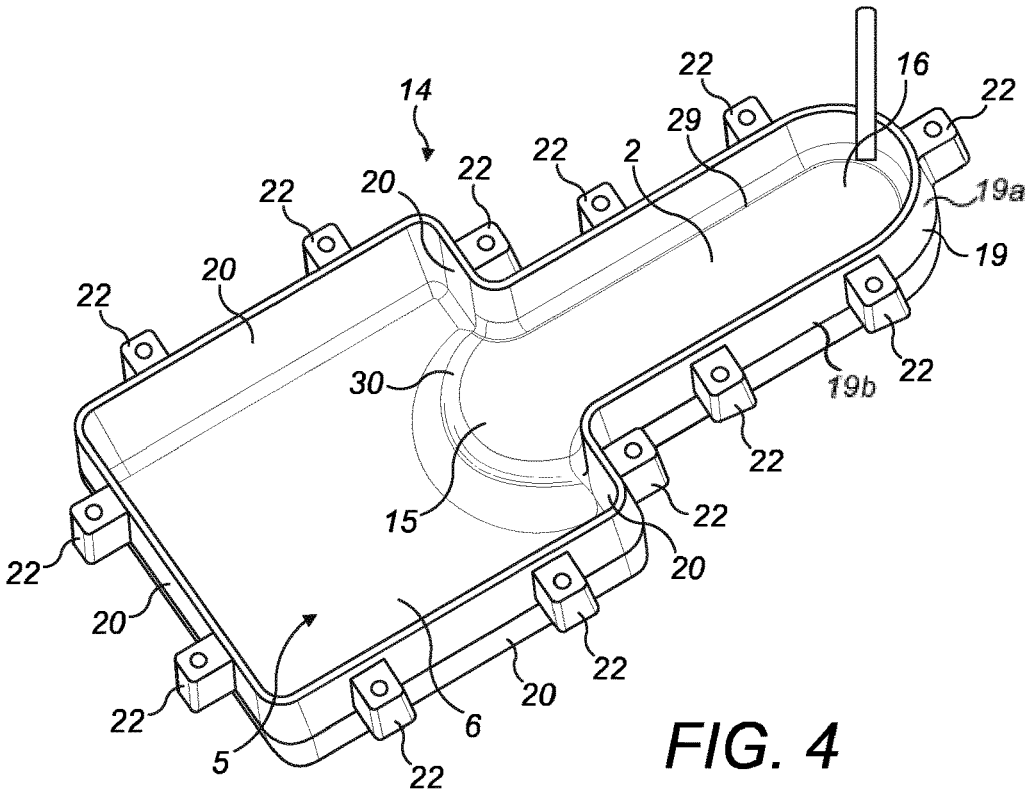
FIG. 4 is an isometric view of a third embodiment of the present invention.

The casing (14) of a third embodiment of the invention is shown in FIG. 4, and like features in this embodiment retain the same reference numerals. As in the above embodiments, a flat heated plate (2) is provided inclined at least 45 degrees from the horizontal (H) to define upper (16) and lower ends (15) of the plate (2). The plate (2) is an elongate shape, with sides (29), and curved portions(30) that delimit the upper (16) and lower ends (15) of the plate (2) respectively. The plate (2) is partially bordered by a wall (19) that extends perpendicular thereto and is arranged along the sides (29) and curved portions (30). The wall (19) includes a wall portion (19*a*) along the upper curved side (30) and wall portions (19*b*) along the sides (29). The boundary formed by the wall (19) is open at the plate's (2) lower end (15) so that the plate (2) communicates with the scale collection container (5). In this embodiment, the scale collection container (5) has a bottom surface (6) that extends from the lower end (15) of the plate (2) below and in a plane parallel to the plate (2), therefore the bottom surface (6) is oriented at least 45 degrees from the horizontal (H) when the casing (14) is in an operative position. In this embodiment, the bottom surface (6) comprises a rectangular flat surface that is substantially wider than the elongate flat plate (2). The lower ended (15) curved side (30) of the plate (2) overlaps and bisects one side of the bottom surface of the scale collection container (5). As in above embodiments, the scale collection container (5) comprises lateral walls (20) upstanding perpendicularly from outer edges of the bottom surface (6) to provide a receptacle into which scale is deposited. In this embodiment, the lateral walls (20) extend around the outer edges of the bottom surface (6) to meet the walls (19) extending along long parallel sides (29) of the plate (2) where the plate (2) overlaps the bottom surface (6).

Lugs (22) arranged around the outer surface of the casing (14) are configured to allow the casing (14) to be mounted by screw fixtures to the lid (not shown). Each screw fixture passes through a hole formed in the lid (not shown) which is then threadably engaged with the lug (22) to create a sealed space for steam generation. As in above embodiments, water inlets (not shown) are provided in the lid and arranged to dispense water onto the upper end (16) of the plate (42).

Figure 6:
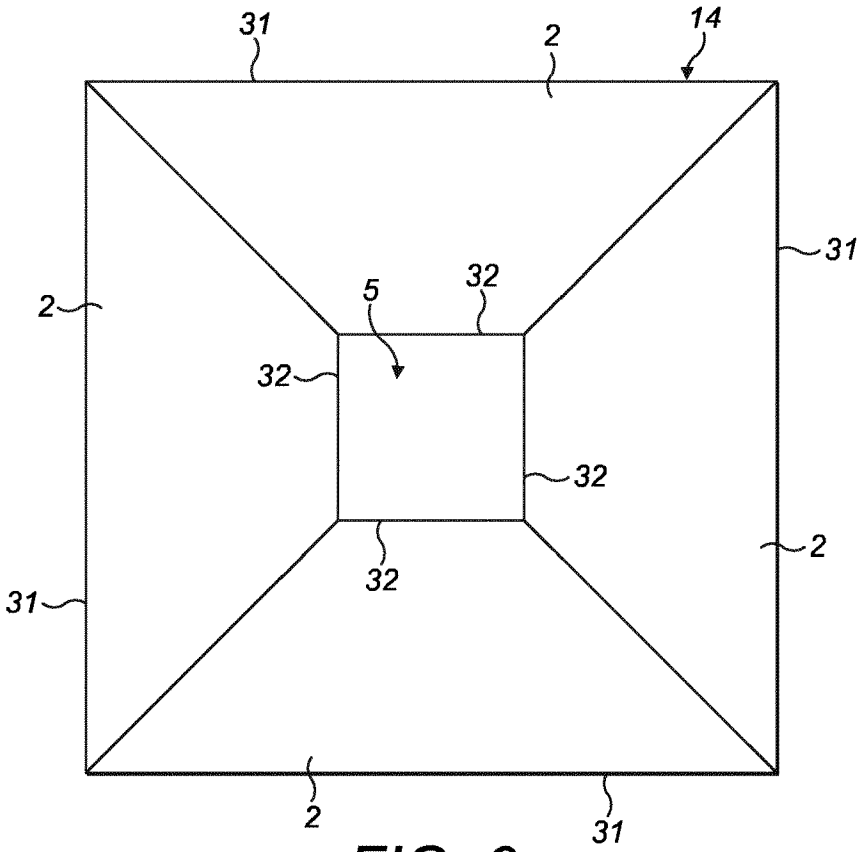
FIG. 6 is a top view of the embodiment shown in FIG. 5.
Figure 5:
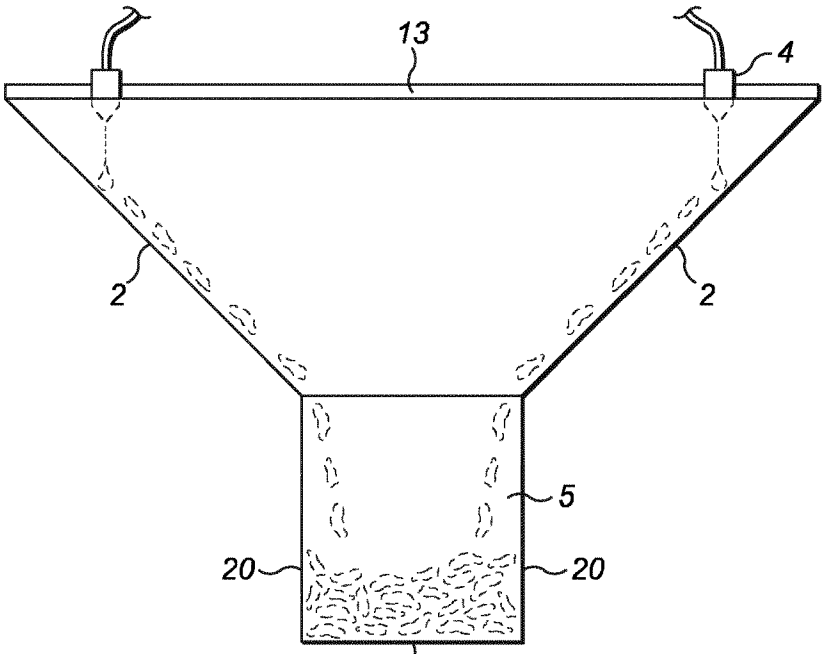
FIG. 5 is a side elevation view of a fourth embodiment of the present invention.

The casing (14) of a fourth embodiment of the invention is shown in FIGS. 5 and 6. According to this embodiment, the device (1) for generating steam comprises a plurality of plates (2) which surround the container (5). For example, four flat trapezoidal heated plates (2) are arranged to surround a scale collection container (5). The plates (2) are arranged such that the plates' (2) surfaces form an open ended frustum pyramid. Upper edges (31) of the plates (2) define the larger open ended face of the frusto-pyramidal shape, with lower edges (32) of the plates (2) defining the small open ended face of the frusto-pyramidal shape.

As above, the scale collection container (5) comprises a four sided base that forms the bottom surface (6), with adjoining lateral walls (20) upstanding off of each side of the bottom surface (6) to define a receptacle into which scale is deposited. The upper edges of the lateral walls adjoin the lower edges (32) of the plates (2). In this embodiment, as in above embodiments, the plates (2) and scale collection container (5) are integrated to form the casing (14).

A lid (13) is provided to enclose the top of the casing and provide a sealed environment for steam generation. The lid may be attached to the casing (14) by any suitable means. Water inlets (4) may be provided in the lid to dispense water onto the plate (2) adjacent the upper edges of the plate (31).

Figure 7:
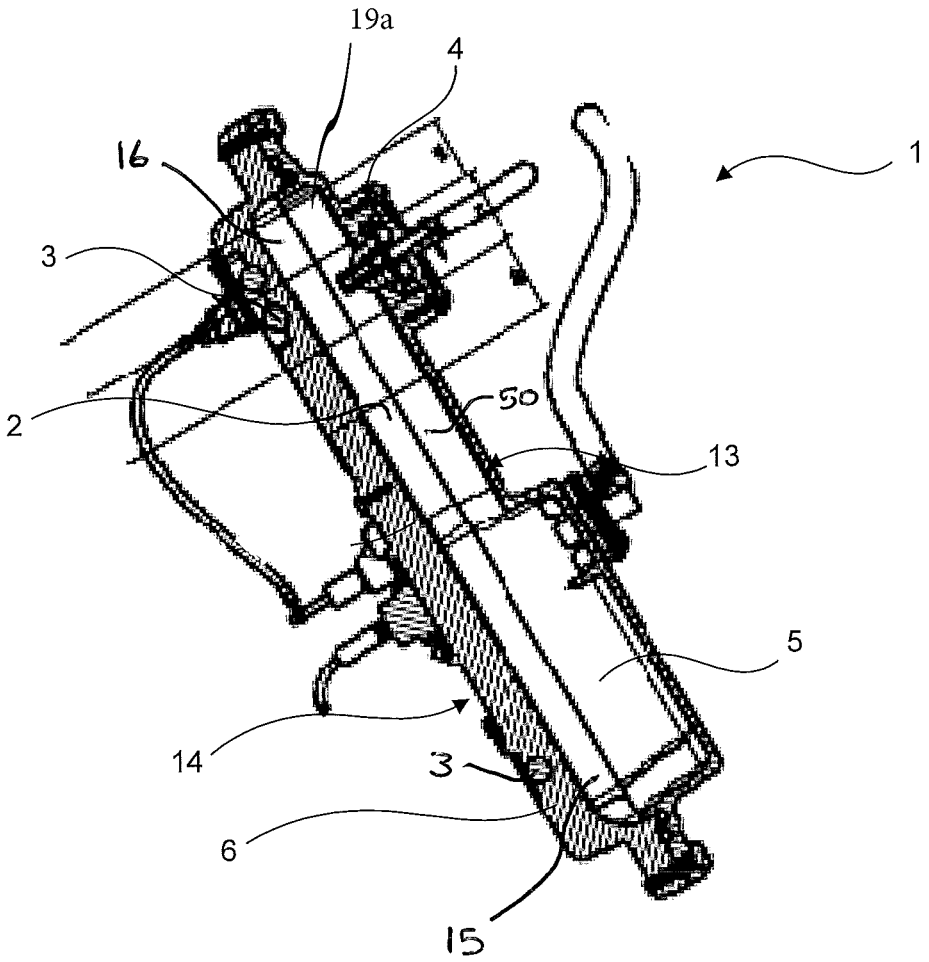
FIG. 7 is a cross-sectional side view of a fifth embodiment of the present invention.

A cross-sectional side view of a fifth embodiment of the invention is shown in FIG. 7. According to this embodiment, the steam generation device (1) for generating steam comprises a casing (14) and a lid (13) with a water inlet arrangement (4). The casing (14) comprises a plate (2) inclined at least 10 degrees relative to the horizontal when the steam generation device (1) is in an operative position. Preferably, the plate (2) is inclined at least 60 degrees relative to the horizontal, as shown in FIG. 7, when the steam generation device (1) is in an operative position. A steam generating chamber (50) is formed from an area extending between the plate (2) an the lid (13). The device (1) may have a wall portion (19*a*) along a short side of the plate (2) and wall portions (not shown in FIG. 7) along the long sides of the plate (2).

The casing (14) of the fifth embodiment of the present invention further comprises a scale collection container (5). The scale collection container (5) is disposed adjacent to a lower end (15) of the plate (2). In this embodiment, the scale collection container (5) is formed from an enlarged region of the steam generating chamber (50) and is located between the plate (2) and the lid (13). The casing (14) further comprises a heating element (3) to heat the plate (2). The temperature of the plate (2) and the flow of water onto the plate (2) is controlled so that substantially all the water dispensed onto the plate (2) is evaporated before it reaches the lower end (15) of the plate (2) so that water does not collect in the scale collection container (5). Preferably, the temperature and/or flow of water is controlled so that substantially all the water is evaporated before it enters the scale collection region (5) but, in other embodiments, the temperature of the plate and the flow of water may be controlled so that some water does enter the scale collection region (5). In this case, the water is evaporated by the heat from the plate (2) before it reaches the lower end (15) of the plate (2) to prevent water from pooling at the lower end (15) of the plate (2).

It shall be appreciated that all of the above embodiments may include an opening (9), such as that shown in FIGS. 1 and 2, in a surface of the scale collection container (5) to allow scale to be removed from the scale collection container. However, it is intended within the scope of the invention that such an opening (9) may be omitted, and in such embodiments, the scale collection container (5) is intended to store all the scale that is likely to be dislodged by flaking within the lifespan of the product. This provides the advantage that the steam generation device (1) is capable of operating maintenance free throughout its lifespan.

Furthermore, embodiments are intended within the scope of the invention in which the scale collection container (5) is not integrally formed with the plate (2). This may allow the scale collection container (5) to be removed from the device (1) to facilitate emptying of the scale collection container (5) of scale. The size and volume of the scale collection container (5) in this example is configured to define how often the scale collection device must be removed from the device (1) to maintain performance. In one example, when the scale collection container (5) is full of scale, the scale collection container (5) may be removed and replaced with a new, empty, scale collection container (5). In another example the scale collection container (5) may be reusable, so that when the full scale collection container (5) is full, the scale collection container (5) is removed and emptied before being replaced in the steam generation device (1).

In operation of the device (1) in all embodiments, scale that does form on the plate (2) is steadily removed by the flaking process and the action of gravity. As scale is dislodged from the plate's (2) surface by the flaking process, the loose flakes of scale work their way down the inclined plate (2) under the influence of gravity, water flowing down the plate (2) also helps to carry loose flakes down the plate (2), so that the flakes are collected in the scale collection container (5).

Although in the above embodiments the water is applied to the plate's (2) surface in droplet form, it shall be appreciated that the water may be provided to the steam generation device (1) in any way such that allows a film of water to be formed on the plate's (2) surface. For example, the water inlet (4) may be configured to drip water onto the plate (2) at a regular rate. Alternatively, the water inlet (4) may be configured to feed a constant stream of water onto the plate (2). Alternatively, the water inlet (4) may be configured to spray the water onto the plate (2) so that water is simultaneously provided to the plate (2) in multiple positions. Alternatively, there may be one inlet that is moveable such that it can be repositioned to introduce water to different positions on the plate (2). In this way, substantially all of the water being fed into the steam generation device (1) is evaporated on the plate (2) and does not flow into the adjacent scale collection region. Therefore, substantially no water enters the scale collection region and so the water cannot react with the accumulated scale to create foam and impure steam.

Water may also be provided to multiple positions on the plate (2) in a sequential manner. In this way, the water will act to cool different areas of the plate (2), and scale on the plate (2), at different rates and by different amounts. That is, areas of the plate (2) which are directly provided with water will be cooled more rapidly than other areas of the plate (2), which will cause scale on the plate (2) to cool at different rates. This differential cooling and heating will result in stresses and strains within the scale which will cause the scale to break apart, come detached from the plate (2) and fall into the scale collection container (5).

It shall be appreciated that steam generated within the steam generation device (1) may result in a significant positive pressure being exerted on the casing (14). The pressure differential that exists between the inside and the outside of the device (1), and therefore the pressure load exerted on the casing (14), will depend on the application of the device (1). Therefore, the casing (14) and lid (13) should be made from suitable materials and be designed accordingly. The casing is also required to conduct heat from the heating element (3) to the plate's (2) surface. For example, the casing (14) may be made from a metal, such as aluminium. The lid may be made from a metal or a polymer material. In any case, the materials should be suitable to safely deal with the temperature and pressure associated with the application of the steam generation device (1).

It will also be appreciated that the steam generation device (1) may be configured to hold steam at a pressure which is greater than atmospheric pressure so that steam can be released at any time. In this case, the water inlet (4) may be configured to open and allow water into the steam generation device (1) when the pressure within the chamber falls below a certain level. Also, it should be considered that the boiling point of water increases as pressure increases so the heating element (3) and other components need to be selected and/or designed according to the required pressure and temperature. It will be appreciated that the maximum steam pressure can be regulated by controlling the temperature of the plate (2) and the water feed rate through the water inlet (4).

The size and area of the plate's (2) surface is selected to provide an appropriate steam generation rate. The required steam generation rate will depend on the application of the device (1), the pressure limitations of the casing and lid (13), and the maximum water feed rate and the size of the device (1). The plate (2) surface has a sufficient size and temperature to evaporate substantially all of the water that is fed onto the plate (2) surface so that little or no water enters the scale collection container (5). For example, the plate (2) surface and the flow of water dispensed onto the plate (2) vary proportionally.

According to the invention, the plate's (2) surface may optionally be provided with some coating or surface finish that also helps to prevent scale from becoming bonded thereon so that the scale is more easily broken apart and dislodged when subjected to thermal shock. For example, a non-stick coating such as PTFE or a ceramic coating, or alternatively a highly polished surface finish may be provided to make it more difficult for the scale to form into large particles and flakes on the plate's (2) surface. Furthermore, in one embodiment, the steam outlet (24) may be provided with a hydrophobic surface or interfacing part to prevent the adhesion of scale particles in the vicinity of the steam outlet (24).

It will also be appreciated that the steam generating device (1) may further comprise steam enhancing features. The steam enhancing features may include a steam promoter (not shown) configured to increase the steam rate of the device (1) or a grid structure (not shown). The grid structure may comprises an array of columns or pillars (not shown) which are configured to increase the surface area of the plate (2) which increases the surface area over which heat can be transferred from the surface of the plate (2) to the water to increase the steam rate.

Preferably, according to the invention, the steam generating device (1) further comprises a water tank (not shown) for supplying water to the water inlet.

The invention also relates to a method of collecting scale in a device for generating steam as previously described. The method comprises the steps of:

heating (S1) a plate (2) inclined at an angle (A0) compared to the horizontal direction (H), the plate (2) being heated to a predetermined temperature being at least above water evaporation temperature, the plate (2) defining an upper end (16) and a lower end (15), dispensing (S2) water on said plate (2) proximate said upper end (16), collecting (S3) in a container (5) any scale falling down from the plate (2), the container (5) being disposed adjacent to said plate (2) and comprising a bottom surface portion (6) extending at least below said lower end (15).

Preferably, the method further comprises the additional steps of:

controlling (S4) the temperature of said plate (2), controlling (S5) the rate of water dispensed on said plate (2), such that water dispensed to the plate (2) is evaporated before water reaches the lower end (15) of the plate (2).

The above embodiments as described are only illustrative, and not intended to limit the technique approaches of the present invention. Although the present invention is described in details referring to the preferable embodiments, those skilled in the art will understand that the technique approaches of the present invention can be modified or equally displaced without departing from the scope of the present invention, which fall into the protective scope of the claims of the present invention. In the claims, the word "comprising" does not exclude other elements or steps, and the indefinite article "a" or "an" does not exclude a plurality. Any reference signs in the claims should not be construed as limiting the scope.

The invention claimed is:

1. A device for generating steam, the device comprising:

a plate forming a surface, the plate being inclined at an angle (A0) compared to a horizontal direction (H) to define an upper end and a lower end, the plate being partially bordered by a wall configured to ensure water is guided down the plate towards the lower end;

a heating element to heat the plate to a temperature being at least above water evaporation temperature;

at least one water inlet for dispensing water onto the plate proximate the upper end of the plate;

a scale collection container, disposed adjacent to the lower end of the plate, for collecting scale falling from the plate; and a control unit configured to control flow of water dispensed onto the plate and the temperature of the plate so that substantially all the water dispensed onto the plate evaporates before it reaches the lower end of the plate, so that the water does not react with the scale collected in the scale collection container.

2. The device of claim 1, wherein the plate has at least one channel extending between the upper end and the lower end.

3. The device of claim 2, wherein the at least one channel comprise a plurality of channels extending in parallel.

4. The device of claim 1, wherein the scale collection container comprises a bottom surface portion extending downwards in a plane parallel to a plane of the plate.

5. The device of claim 3, wherein the at least one water inlet comprises multiple water inlets to dispense water onto multiple regions of the plate proximate the upper end of the plate.

6. The device of claim 5, wherein the number of water inlets equals the number of the plurality of channels, and wherein each of the water inlets faces one channel of the plurality of channels, respectively.

7. The device of claim 1, wherein the scale collection container comprises a bottom surface portion having a horizontal surface portion lower than the lower end of the plate.

8. The device of claim 1, wherein the scale collection container comprises a bottom surface portion and a plurality of lateral walls which surround the bottom surface portion.

9. The device of claim 1, wherein the scale collection container is formed integrally with the plate.

10. The device according to claim 1, wherein the plate is inclined at least 45 degrees from the horizontal.

11. The device according to claim 1, wherein the scale collection container comprises a plurality of walls, an opening being formed in at least one of the walls to access an inside part of the scale collection container, the opening being closed by a cover.

12. A steamer appliance comprising a device for generating steam according to claim 1.

13. The steamer appliance according to claim 12, further comprising a water pump controlled by the control unit to deliver the water to the water inlet in dependence on the temperature.

14. A method of collecting scale in a device for generating steam, the method comprising:

heating a plate inclined at an angle (A0) compared to a horizontal direction (H), the plate being heated to a temperature at least above water evaporation temperature, the plate defining an upper end and a lower end, and being partially bordered by a wall configured to ensure water is guided down the plate towards the lower end;

dispensing water on the plate proximate the upper end;

controlling flow of the water dispensed onto the plate and temperature of the plate so that substantially all the water dispensed onto the plate evaporates before it reaches the lower end of the plate, so that the water does not react with scale collected in a scale collection container disposed adjacent to the lower end of the plate; and collecting in the scale collection container the scale which falls down from the lower end of the plate.

15. The method of claim 14, wherein the plate defines a plurality of parallel channels.

16. The method of claim 15, wherein dispensing the water on the plate comprises dispensing the water in each of the plurality of parallel channels through a corresponding plurality of inlets.

17. The method of claim 14, wherein the scale collection container comprises a bottom surface portion having a horizontal surface portion lower than the lower end of the plate.

18. The method of claim 1, wherein the scale collection container further comprises a plurality of lateral walls surrounding the bottom surface portion.

19. A device for generating steam, comprising:

a plate having a planar top surface, the plate being inclined at an angle (A0) compared to a horizontal direction (H) to define an upper end and a lower end, the plate being partially bordered by a wall configured to ensure water is guided down the plate towards the lower end;

a heating element configured heat the plate to a temperature at least above water evaporation temperature;

at least one water inlet configured to dispense water onto the plate proximate the upper end of the plate;

a scale collection container disposed adjacent to the lower end of the plate and configured to collect scale falling from the plate, the scale collection container comprising a plurality of lateral walls connected to the wall of the plate and providing a receptacle in which the scale is collected; and a control unit configured to control flow of the water dispensed onto the plate and the temperature of the plate such that water dispensed onto the plate evaporates before it reaches the lower end of the plate to prevent reaction with the scale collected in the scale collection container.

20. The device of claim 19, further comprising:

a casing formed of at least the wall bordering the plate and the plurality of lateral walls of the scale collection container; and a lid fixed onto the casing to enclose the device.

* * * * *